US008054188B2

(12) United States Patent
Harkins et al.

(10) Patent No.: US 8,054,188 B2
(45) Date of Patent: Nov. 8, 2011

(54) CARBON MONOXIDE DETECTOR, SYSTEM AND METHOD FOR SIGNALING A CARBON MONOXIDE SENSOR END-OF-LIFE CONDITION

(75) Inventors: Michael T. Harkins, Portland, OR (US); Bradley B. Barnes, Tualatin, OR (US)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 361 days.

(21) Appl. No.: 12/348,704

(22) Filed: Jan. 5, 2009

(65) Prior Publication Data

US 2010/0171608 A1 Jul. 8, 2010

(51) Int. Cl.
*G08B 17/10* (2006.01)
*G08B 21/00* (2006.01)

(52) U.S. Cl. ..... 340/632; 340/636.1

(58) Field of Classification Search ..... 340/632, 340/633, 634, 636.1
See application file for complete search history.

(56) References Cited

U.S. PATENT DOCUMENTS

| | | | | |
|---|---|---|---|---|
| 4,232,308 | A * | 11/1980 | Lee et al. | 340/539.3 |
| 4,384,283 | A * | 5/1983 | Drope et al. | 205/775 |
| 5,646,598 | A | 7/1997 | Nickles et al. | |
| 5,966,078 | A * | 10/1999 | Tanguay | 340/636.1 |
| 6,348,871 | B1 * | 2/2002 | Tanguay et al. | 340/628 |
| 6,646,566 | B1 | 11/2003 | Tanguay | |
| 7,205,901 | B2 * | 4/2007 | Demster | 340/636.1 |
| 7,817,499 | B2 * | 10/2010 | Solhjoo et al. | 368/10 |
| 2003/0090374 | A1 | 5/2003 | Quigley | |
| 2006/0152335 | A1 | 7/2006 | Helgeson | |
| 2006/0173579 | A1 | 8/2006 | Desrochers et al. | |
| 2007/0085692 | A1 * | 4/2007 | Grant et al. | 340/632 |
| 2009/0315669 | A1 * | 12/2009 | Lang et al. | 340/3.1 |

* cited by examiner

*Primary Examiner* — Jennifer Mehmood
(74) *Attorney, Agent, or Firm* — Kinney & Lange, P.A.

(57) ABSTRACT

A CO detector includes a sensor configured to detect a presence of CO and generate a signal indicative of the presence of CO, and a controller in signal communication with the sensor. The controller is configured to measure a level of detected CO in response to receiving the signal generated by the sensor. The controller is further configured to detect a first trouble condition representative of an end-of-life condition of the sensor, and a second trouble condition different from the first trouble condition.

13 Claims, 3 Drawing Sheets

CARBON MONOXIDE DETECTOR, SYSTEM AND METHOD FOR SIGNALING A CARBON MONOXIDE SENSOR END-OF-LIFE CONDITION

BACKGROUND THE INVENTION

1. Field of the Invention

The embodiments described herein relate generally to signaling an end-of-life of a carbon monoxide (CO) sensor and, more particularly, to a method and system for transmitting a CO sensor end-of-life signal of a sensor to a remote agent.

2. Description of the Prior/Related Art

Carbon monoxide (CO) is an odorless, poisonous gas, which can be generated by, for example, gas furnaces, water heaters, ranges, space heaters, wood stoves, cars, portable generators, and gas-powered gardening equipment. Once inhaled, CO inhibits red blood cells from carrying oxygenated blood to the body, thus preventing oxygen from reaching organs in the body. This oxygen deprivation can cause varying amounts of damage depending on a level of exposure. Low level exposure can cause flu-like symptoms including shortness of breath, mild headaches, fatigue, and nausea. However, higher level exposure may cause dizziness, mental confusion, severe headaches, nausea, fainting, or even death.

As public and media awareness of the dangers of CO continue to rise, so does the popularity of devices that detect a presence of CO. The two general types of CO detectors are monitored CO detectors and non-monitored CO detectors. With non-monitored CO detectors, if a threshold level of CO is detected, the non-monitored CO detector sounds an alarm providing occupants of a building, such as residents of a single family house, an apartment building, a condominium or occupants of an office building, for example, an opportunity to ventilate an area or safely leave the building where the high level of CO is detected, much like a common house-hold smoke alarm. Monitored CO detectors, while similar to non-monitored CO detectors, include an advantage of being directly connected to a monitoring company. Therefore, if a high level of CO is detected by the monitored CO detector, the monitored CO detector not only sounds an alarm giving occupants of the building a chance to ventilate an area or safely leave the building, but also transmits an alarm signal to the monitoring company, alerting the monitoring company of the detected high level of CO. The monitoring company verifies the alarm signal, notifies key holders (e.g., occupants), and offers fire, police and/or medical services. Thus, the CO detectors facilitate notifying and/or protecting occupants that are away, sleeping, or already suffering from effects of CO.

In addition to an alarm signal, if another condition is detected by the monitored CO detector, for example, a loss of power to the monitored CO detector, component failure, or an end-of-life of a limited-life sensor, the monitored CO detector transmits a trouble signal to the monitoring company, alerting the monitoring company of the detected condition. Thus, unlike an alarm signal, which is only transmitted when a high level of CO is detected, a trouble signal is transmitted when other preselected conditions such as any one of the above conditions, occur. Further, because an alarm signal and a trouble signal are two separate signals transmitted from a monitored CO detector, the monitoring company can differentiate between the alarm signal and the trouble signal. However, all trouble signals are identical. Thus, when a trouble signal is received by the monitoring company, the monitoring company does not know whether, for example, a loss of power has been detected or an end-of-life of the limited-life sensor has been detected. Knowing which condition has occurred when a trouble signal is received may facilitate an appropriate response by the monitoring company.

BRIEF DESCRIPTION OF THE INVENTION

Systems and methods are provided herein that allow a carbon monoxide (CO) detector to transmit a signal representative of an end-of-life of a sensor in the CO detector, and further, allows a monitoring agency to differentiate the end-of life signal from standard trouble signals. Therefore, knowing a difference between an end-of-life signal and a standard trouble signal saves expense by knowing what service calls need addressing immediately and what service calls are not as immediate. For example, an end-of-life signal, which requires a service call, the immediacy of a service call for an end-of-life signal is not as immediate as a service call that stems from a standard trouble signal.

In one aspect, a carbon monoxide (CO) detector is provided. The CO detector includes a power supply, a sensor configured to detect a presence of CO and generate a signal indicative of the presence of CO, and a controller in signal communication with the sensor. The controller is configured to measure a level of detected CO in response to receiving the signal generated by the sensor. The controller is further configured to detect a first trouble condition representative of an end-of-life condition of the sensor, and a second trouble condition different from the first trouble condition. The CO detector further includes a first transmitter mechanism operatively coupled to the controller. The first transmitter mechanism is configured to transmit, to a remote agent, a first trouble signal indicative of the first trouble condition, and a second trouble signal indicative of the second trouble condition. The first trouble signal being different from the second trouble signal.

In another aspect, a system is provided that includes a remote agent and a CO detector. The CO detector includes a power supply, a sensor configured to detect a presence of CO and generate a signal indicative of the presence of carbon monoxide, and a controller in signal communication with the sensor. The controller is configured to measure a level of detected CO in response to receiving the signal generated by the sensor. The controller is further configured to detect a first trouble condition representative of an end-of-life condition of the sensor, and a second trouble condition different from the first trouble condition. The CO detector further includes a first transmitter mechanism operatively coupled to the controller. The first transmitter mechanism is configured to transmit, to the remote agent, a first trouble signal indicative of the first trouble condition, and a second trouble signal indicative of the second trouble condition.

In yet another aspect, a method for monitoring a carbon monoxide detector is provided. The method includes detecting an end-of-life condition of a sensor, generating a signal indicative of a presence of the end-of-life condition of the sensor, and transmitting a first trouble signal indicative of a first trouble condition representative of the detected end-of-life condition of the sensor to a remote agent. The first trouble signal is different from a second trouble signal representative of at least one second trouble condition different than the first trouble condition.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION OF THE INVENTION

Figure 1:
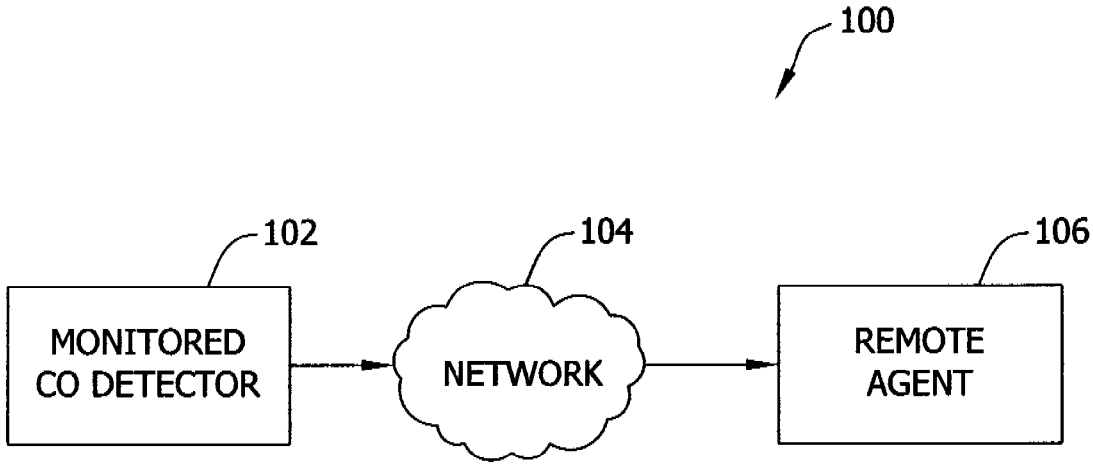
FIG. 1 is a block diagram of an exemplary system architecture suitable for use in implementing embodiments of the present disclosure.

Referring initially to FIG. 1, a block diagram of an exemplary system architecture is shown and designated generally as system 100. The system 100 is but one example of a suitable system and is not intended to suggest any limitation as to the scope of use or functionality of the present disclosure.

Embodiments of the present disclosure enable a carbon monoxide (CO) detector, such as a monitored CO detector 102 in FIG. 1, to communicate with a remote agent 106 via a network 104. In the exemplary embodiment, the monitored CO detector 102 may be a conventional CO detector or an addressable CO detector. A conventional CO detector provides static outputs for alarm and trouble. In one embodiment, the static outputs take the form of relay outputs that show a change of state for a change of status (e.g., alarm or trouble). In a further embodiment, an addressable CO detector uses a communications protocol over many forms of media (e.g., wireless, two wire, power line, and the like), to communicate are various status conditions.

Further, the remote agent 106 may include a monitoring company, a cellular phone, a personal data assistant or other handheld device, a personal computer, a desktop computer, a server computer, a laptop computer, a control panel, a multiprocessor system, a microprocessor-based system, a set top box, a programmable consumer electronic, a network PC, a minicomputer, a mainframe computer, and/or distributed computing environments that include any of the above systems or devices, and the like.

In one embodiment, the network 104 includes radio frequency and wired connection endpoints and bridges for standard mobile phone communication technologies, such as a global system for mobile communications (GSM), 3G mobile communication technology, code division multiple access (CDMA), and universal mobile telecommunications system (UMTS). The network 104 may also include an interface to receive satellite signals, local mobile transmitters, and other technologies via wireless fidelity (Wi-Fi) networks and wireless protocol utilizing short-range communications technology facilitating data transmission over short distances from fixed and/or mobile devices.

Figure 2:
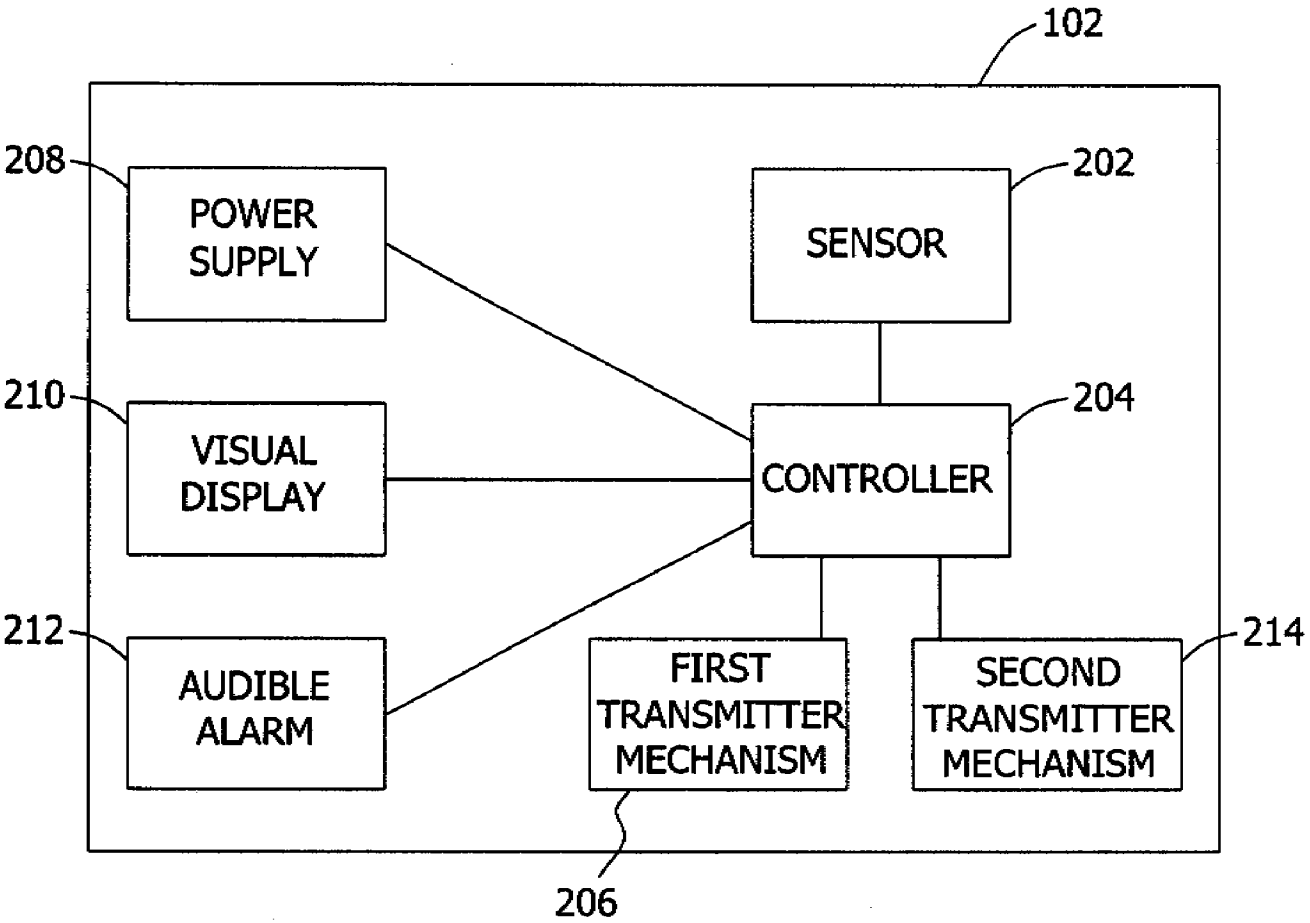
FIG. 2 is a block diagram of an exemplary monitored carbon monoxide detector suitable for use in implementing embodiments of the present disclosure.

Referring now to FIG. 2, the monitored CO detector 102 includes a sensor 202, a controller 204, a first transmitter mechanism 206, a second transmitter mechanism 214, a power supply 208, a visual display 210, and an audible alarm 212. The diagram of FIG. 2 is merely illustrative of an exemplary CO detector that can be used in connection with one or more embodiments of the present disclosure, and is not intended to be limiting in any way. Further, peripherals or components of the monitored CO detector 102 known in the art and not shown, are operable with one or more embodiments of the present disclosure.

In one embodiment, the sensor 202 is configured to detect a presence of CO, and to generate an alarm signal (not shown) indicative of the presence of CO. In a further embodiment, the sensor 202 may include a chemical sensor, an electro-chemical sensor, a photoelectron-chemical sensor, and/or an electronic sensor. Referring to FIG. 2, the controller 204 is in signal communication with the sensor 202. In one embodiment, the controller 204 is configured to measure a level of detected CO in response to receiving the alarm signal generated by the sensor 202. In a further embodiment, the controller is configured to determine if the measured level of the detected CO exceeds a threshold level of safe CO. Therefore, once a level of CO is detected by the sensor 202 and, for example, measured to be above a threshold level of safe CO by the controller 204, the audible alarm 212 emits an audible alarm that cautions residents in a home or building to ventilate an area or safely leave the home or building where the high level of CO is detected. Further, the monitored CO detector 102 may also utilize the visual display 210 to present a visual warning. In one embodiment, the visual display 210 includes a blinking light or a liquid crystal display (LCD) screen, to facilitate communicating a measured CO level, as well as other suitable operating information, as described.

As described above, the monitored CO detector 102 may include several different types of sensors. However, sensors capable of detecting CO are considered to have a limited life. For example, a typical lifespan of a CO detecting sensor is from about 3 years to about 5 years and should be replaced after that time. In an embodiment, the controller 204 is configured to measure a level of detected carbon monoxide in response to receiving a signal indicative of a presence of carbon monoxide generated by the sensor. The controller 204 further configured to detect a first trouble condition representative of an end-of-life condition of the sensor 202, and a second trouble condition different from the first trouble condition. In an embodiment, the second trouble condition may be representative of any other trouble condition detected by the monitored CO detector 102, for example, a loss of power to the monitored CO detector 102, a lack of power to the monitored CO detector 102, or a presence of CO. Thus, the controller 204 is configured to differentiate between an end-of-life condition and other trouble conditions and generate corresponding first and second signals. The power supply 208 may be a battery, such as a disposable or rechargeable battery, or an electrical connection to an exterior power source.

With reference to FIGS. 1 and 2, in one embodiment, the first transmitter mechanism 206 is operatively coupled to the controller 204. The first transmitter mechanism 206 is configured to transmit, to the remote agent 106, a first trouble signal indicative of the first trouble condition, and a second trouble signal indicative of the second trouble condition. In embodiments, the second transmitter mechanism is configured to transmit, to the remote agent 106, a first trouble signal indicative of the first trouble condition, and a second trouble signal indicative of the second trouble condition. With current CO detectors, all trouble signals are transmitted as constant signals and, therefore, a monitoring company, for example the remote agent 106, cannot determine a type of condition that resulted in a transmission of a trouble signal. Thus, when a trouble signal, from a conventional CO detector is received by the monitoring company, the monitoring company does not know and cannot determine whether, for example, a loss of power has been detected or an end-of-life of the sensor 202 has been detected. Therefore, to overcome this deficiency, in one embodiment, the first trouble signal is different from the second trouble signal to facilitate determining a type of condition that resulted in transmission of the first trouble signal or the second trouble signal. For example, in the exemplary embodiment, the first trouble signal includes at least a pulsated signal and the second trouble signal includes at least a constant signal. In a further embodiment, a pulsated signal is a cycling of the first trouble signal on and off and/or toggling the first trouble signal on and off on about a 0.5 second basis. However, the first trouble signal may include any suitable pulsated signal known to those skilled in the art and guided by the teachings herein provided. Further, such signals may be transmitted at any suitable interval. Therefore, because the first trouble signal is different from the second trouble signal, the remote agent 106 will know, for example, if a loss of power has been detected (represented by the constant second trouble signal) or if an end-of-life of the sensor 202 has been detected (represented by the pulsated first trouble signal). In a further embodiment, a dedicated end-of-life output may be added to the CO detector. The dedicated end-of-life output may be configured to transmit an end-of-life signal to a monitoring company, for example, a remote agent.

Information related to the condition that resulted in the transmission of a trouble signal to the remote agent 106 facilitates proper responsive action by the remote agent 106. For example, if the remote agent 106 is a monitoring company, and the monitoring company receives a second trouble signal representative of a loss of power to a monitored CO detector, the monitoring company must send someone to a location where the particular monitored CO detector is located within a certain period of time, for example four hours, because a loss of power to the monitored CO detector indicates that the monitored CO detector is not working properly, or will stop working within a few days. However, if the monitoring company receives a first trouble signal representative of an end-of-life condition of the sensor 202, the monitoring company may have anywhere from a few days to several weeks before they must send someone to the location where the particular monitored CO detector is located because once the end-of-life of the sensor 202 is detected, the sensor 202 may still work properly for several weeks and maybe months. Thus, knowing which condition has occurred, may not only save time and/or expense, it may also allow for monitoring companies to have more people available for more urgent matters.

Figure 3:
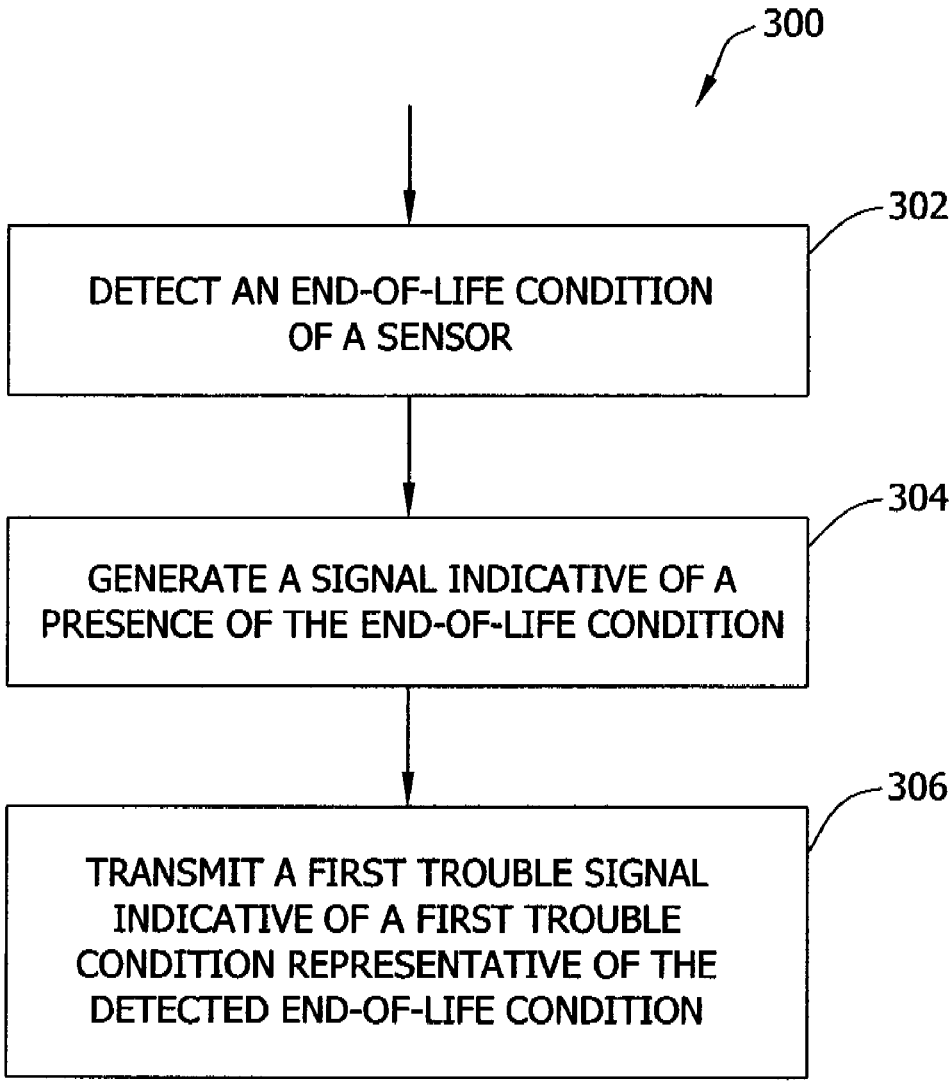
FIG. 3 is a flow diagram of an exemplary method for use in implementing embodiments of the present disclosure.

With reference now to FIGS. 1, 2, and 3, an exemplary method 300 for use of a CO detector including a CO detection sensor in implementing embodiments of the present disclosure will now be described. As mentioned above, sensors capable of detecting CO are considered to have a limited life. Thus, at 302, when an end-of-life condition of the sensor 202 is detected by the controller 204, at 304, the controller 204 generates a first trouble signal which is indicative of a presence of the end-of-life condition of the sensor 202. At 306, the first trouble signal representative of the detected end-of-life condition of the sensor 202 is transmitted to the remote agent 106 via the first transmitter mechanism 206, and a warning is presented to the user at the remote agent 106 indicating that the first trouble signal received indicates an end-of-life condition of the sensor 202.

Embodiments of the disclosure may be described in the general context of computer-executable instructions, such as program modules, executed by one or more computers or other devices. The computer-executable instructions may be organized into one or more computer-executable components or modules. Generally, program modules include, but are not limited to, routines, programs, objects, components, and data structures that perform particular tasks or implement particular abstract data types. Aspects of the present disclosure may be implemented with any number and organization of such components or modules. For example, aspects of the present disclosure are not limited to the specific computer-executable instructions or the specific components or modules illustrated in the figures and described herein. Other embodiments of the present disclosure may include different computer-executable instructions or components having more or less functionality than illustrated and described herein. Aspects of the present disclosure may also be practiced in distributed computing environments where tasks are performed by remote processing devices that are linked through a communications network. In a distributed computing environment, program modules may be located in both local and remote computer storage media including memory storage devices.

The order of execution or performance of the operations in embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

The present disclosure may be described in a general context of computer code or machine-useable instructions, including computer-executable instructions such as program modules, being executed by a computer or other machine, such as a personal data assistant or other handheld device. Generally, program modules including routines, programs, objects, components, data structures, and the like, refer to code that perform particular tasks or implement particular abstract data types. The present disclosure may also be practiced in distributed computing environments where tasks are performed by remote-processing devices that are linked through a communications network.

The subject matter of the present disclosure is described with specificity herein to meet statutory requirements. However, the description itself is not intended to limit the scope of this disclosure. Rather, the inventors have contemplated that the claimed subject matter might also be embodied in other ways, to include different steps or combinations of steps similar to the ones described in this document, in conjunction with other present or future technologies. Moreover, although the terms "step," "block," and/or "operation" may be used herein to connote different elements of methods employed, the terms should not be interpreted as implying any particular order among or between various steps herein disclosed unless and except when the order of individual steps is explicitly described.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A carbon monoxide detector comprising:

a sensor configured to detect a presence of carbon monoxide, and generate a signal indicative of the presence of carbon monoxide;

a controller in signal communication with the sensor, the controller configured to measure a level of detected carbon monoxide in response to receiving the signal generated by the sensor, the controller further configured to detect a first trouble condition representative of an end-of-life condition of the sensor, and a second trouble condition different from the first trouble condition, wherein the second trouble condition comprises one of a lack or loss of power to the carbon monoxide detector and presence of carbon monoxide;

a transmitter mechanism operatively coupled to the controller, the transmitter mechanism configured to transmit, to a remote agent, a first trouble signal indicative of the first trouble condition, and a second trouble signal indicative of the second trouble condition, the first trouble signal being different from the second trouble signal; and an alarm for producing an audible or visual alarm signal indicative of the presence of carbon monoxide.

2. A carbon monoxide detector in accordance with claim 1, wherein the first transmitter mechanism is configured to wirelessly transmit the first trouble signal and the second trouble signal to the remote agent.

3. A carbon monoxide detector in accordance with claim 1, wherein the first trouble signal comprises a pulsated signal.

4. A carbon monoxide detector in accordance with claim 1, wherein the second trouble signal comprises a constant signal.

5. A carbon monoxide detector in accordance with claim 1, further comprising a power supply.

6. A system, comprising:

a remote agent; and a carbon monoxide detector comprising:

a power supply;

a sensor configured to detect a presence of carbon monoxide, and generate a signal indicative of the presence of carbon monoxide;

a controller in signal communication with the sensor, the controller configured to measure a level of detected carbon monoxide in response to receiving the signal generated by the sensor, the controller further configured to detect a first trouble condition representative of an end-of-life condition of the sensor, and a second trouble condition different from the first trouble condition, wherein the second trouble condition comprises one of a lack or loss of power to the carbon monoxide detector and presence of carbon monoxide;

a first transmitter mechanism operatively coupled to the controller, the first transmitter mechanism configured to transmit, to the remote agent, a first trouble signal indicative of the first trouble condition, and a second trouble signal indicative of the second trouble condition, wherein one of the first and second trouble signals is a pulsated signal and the other is a constant signal; and an alarm for producing an audible or visible alarm signal indicative of the presence of carbon monoxide.

7. A system in accordance with claim 6, wherein the first trouble signal comprises a pulsated signal.

8. A system in accordance with claim 6, wherein the second trouble signal comprises a constant signal.

9. A system in accordance with claim 6, wherein the remote agent is one of a mobile phone, a PDA, a desktop computer, a laptop computer, a hand held computer, a control panel, and a server.

10. A method for monitoring a carbon monoxide detector, the method comprising:

measuring a presence of carbon monoxide;

generating a signal indicative of the presence of carbon monoxide;

producing an audible or visual alarm signal indicative of the presence of carbon monoxide;

detecting an end-of-life condition of a sensor;

generating a signal indicative of a presence of the end-of-life condition of the sensor;

transmitting a first trouble signal indicative of a first trouble condition representative of the detected end-of-life condition of the sensor to a remote agent; and transmitting a second trouble signal representative of one of a lack or loss of power to the carbon monoxide detector, and presence of carbon monoxide to the remote agent, wherein the first trouble signal is distinguishable from the second trouble signal.

11. A method in accordance with claim 10, further comprising pulsating the first trouble signal.

12. A method in accordance with claim 10, further comprising holding the second trouble signal constant.

13. A method in accordance with claim 10, wherein the first trouble signal is transmitted to one of a mobile phone, a PDA, a desktop computer, a laptop computer, a hand held computer, a control panel, and a remote agent.

* * * * *